US007625149B2

(12) United States Patent
Hanson et al.

(10) Patent No.: US 7,625,149 B2
(45) Date of Patent: Dec. 1, 2009

(54) METHOD AND APPLICATOR FOR APPLYING HYDROPHOBIC COMPOSITIONS TO SURFACES

(75) Inventors: Eric L. Hanson, Carlsbad, CA (US); Bruce Jackson, Escondido, CA (US)

(73) Assignee: Aculon, Inc., San Diego, CA (US)

( * ) Notice: Subject to any disclaimer, the term of this patent is extended or adjusted under 35 U.S.C. 154(b) by 40 days.

(21) Appl. No.: 12/080,054

(22) Filed: Mar. 31, 2008

(65) Prior Publication Data

US 2009/0246387 A1 Oct. 1, 2009

(51) Int. Cl.
*B43K 5/00* (2006.01)

(52) U.S. Cl. ..... 401/198; 401/196

(58) Field of Classification Search ..... 401/16, 401/17, 21, 23, 25, 196, 198, 199, 202, 204, 401/208, 209, 213, 219
See application file for complete search history.

(56) References Cited

U.S. PATENT DOCUMENTS

| | | | | |
|---|---|---|---|---|
| 3,639,131 | A * | 2/1972 | Clarke | 427/239 |
| 5,324,131 | A | 6/1994 | Gardner, III | 401/199 |
| 5,536,095 | A * | 7/1996 | Diamond | 401/146 |
| 6,832,867 | B2 | 12/2004 | Sandbach et al. | 401/17 |

* cited by examiner

*Primary Examiner*—David J Walczak
(74) *Attorney, Agent, or Firm*—William J. Uhl

(57) ABSTRACT

An applicator comprises an applicator tip fixed to a housing. Contained within the housing is a flowable hydrophobic composition of a metal silicon complex. The hydrophobic composition is applied to a surface by rubbing the applicator tip across the surface.

21 Claims, 3 Drawing Sheets

METHOD AND APPLICATOR FOR APPLYING HYDROPHOBIC COMPOSITIONS TO SURFACES

FIELD OF THE INVENTION

The present invention relates to a method and applicator for applying hydrophobic compositions to various surfaces, such as optical surfaces, particularly small optical surfaces such as those associated with eyeglass lenses and electro-optical display devices such as cell phones and personal data assistants.

BACKGROUND OF THE INVENTION

Optical surfaces such as those associated with eyeglass lenses and small electrical display devices are susceptible to dirt collection and smudging. This is particularly true if the surface is a polymeric material. Typically the surface is cleaned by spraying a cleaning solution such as a surfactant dissolved in a water-alcohol mixture and wiped with a cloth or paper towel. However, this cleaning treatment is temporary and offers no lasting protection for dirt collection or smudging.

To provide more lasting protection, it is known to apply hydrophobic coatings to optical surfaces. These coatings can be based on fluoropolymers and provide a somewhat more durable coating which typically lasts from 1 to 2 weeks depending on the hydrophobic material and on the surface being treated. Typically the hydrophobic material is applied by spraying and wiping the excess material from the surface being treated. Although this is an acceptable method for treating large surfaces such as those associated with television screens and computer-screens, it is not particularly effective for treating smaller optical surfaces such as those associated with eyeglass lenses or small electro-optical display devices such as cellular phones and personal data assistants. Spray applying the hydrophobic composition covers not only the optical surface but also to the surrounding surfaces where it is not needed. This results in a waste of a relatively expensive composition.

Also, it is known to apply hydrophobic compositions to windshields using an applicator that comprises a housing in the shape of a deodorant bar with an applicator that dispenses the hydrophobic composition by pressing the applicator tip against the windshield surface and wiping the tip across the surface. However, the hydrophobic composition is a polysiloxane, which does not adhere well to many substrates, particularly polymeric substrates. Even when applied to glass, the applied coating lacks permanency.

The present invention overcomes the above problems by providing a method and an applicator for applying a hydrophobic composition to a surface in which the composition is applied to the surface without wasteful overspray.

SUMMARY OF THE INVENTION

The present invention provides an applicator containing a hydrophobic composition for application to various surfaces. The applicator comprises:

(a) a housing carrying a flowable hydrophobic composition comprising a metal silicon complex;

(b) a means for dispensing the composition; the means being fixed to the housing;

(c) the means for dispensing including an applicator tip for depositing a layer of the composition on a surface in response to contact between the applicator tip and the surface.

The invention also provides a method of treating a surface with the hydrophobic composition using the applicator. The method includes the steps of:

(a) grasping the applicator by hand with the applicator tip pointed towards the surface to be treated;

(b) placing the applicator tip on the surface;

(c) rubbing the applicator tip over the surface so as to deposit a layer of the hydrophobic coating composition on the surface; and (d) removing the applicator tip from the surface.

The metal silicon complex, when applied with the applicator and by the method of the invention, adheres well to many substrates including polymeric substrates.

DETAILED DESCRIPTION

Figure 1:
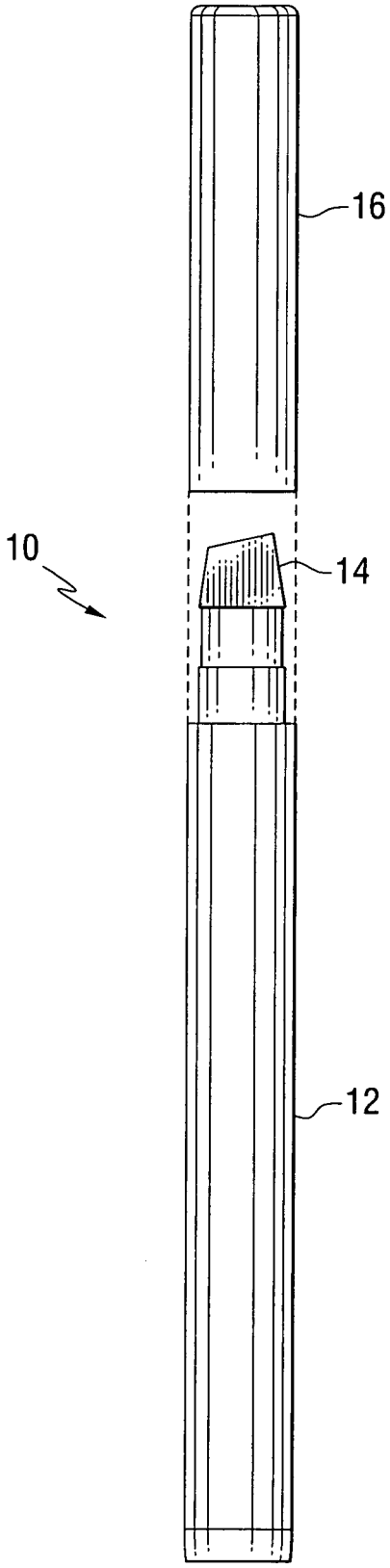
FIG. 1 is an elevational view of an applicator useful in the practice of the invention.

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

The term "polymer" is also meant to include oligomer and copolymer.

Referring now in detail to the drawings, the reference numeral 10 denotes generally an applicator suitable for dispensing the hydrophobic composition in accordance with the invention. The applicator 10 includes an elongate barrel shape body 12 that carries the liquid hydrophobic composition. A fiber applicator 14 is mounted at an end of the body for dispensing the hydrophobic composition. A tight-fitting cap 16 is furnished for preventing evaporation of the hydrophobic composition from the applicator 14 and for augmenting an overall appearance of the applicator in simulation of a writing instrument, for example, a pen, felt tip marker, etc.

Figure 2:
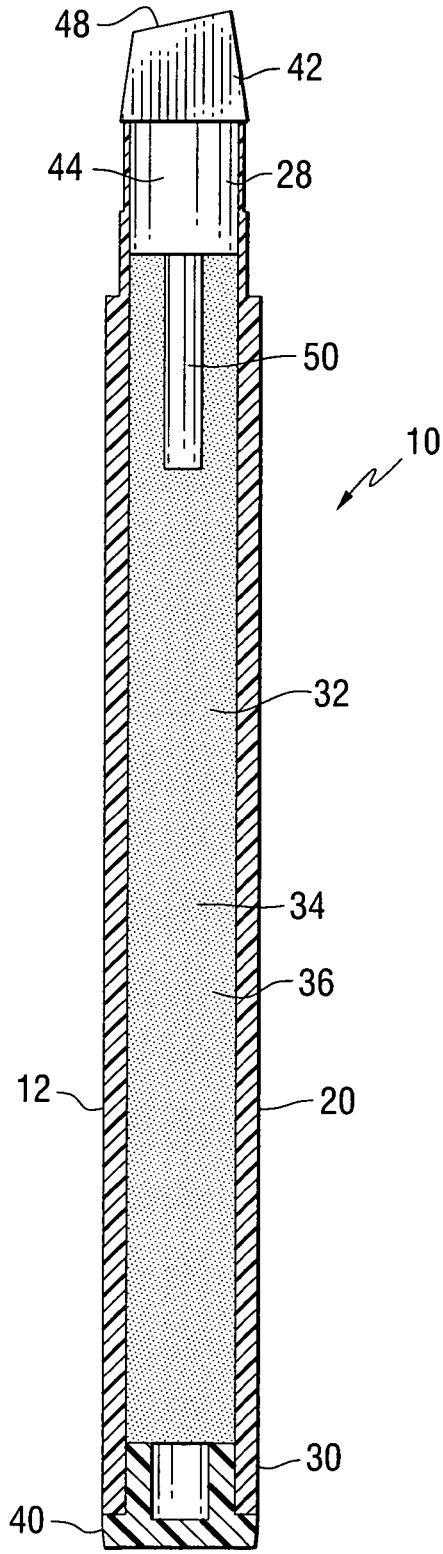
FIG. 2 is a longitudinal sectional view of an applicator useful in the practice of the invention.

With reference now to FIG. 2, the body 12 is formed of a generally cylindrical housing 20 which is typically fabricated of a suitable thermoplastic such as acrylonitrile-butadiene-styrene, polyvinyl chloride, polyethylene, polycarbonates, etc. which are not chemically reactive with the hydrophobic composition. Preferably, the housing is impervious to the transmission of water vapor. The housing 20 includes an elongated generally cylindrical wall extending from a lower end 30 to the dispensing end 28. From the end 28 to an opposite end 30, the housing 20 includes a hollow cylindrical bore 32.

Carried within the cylindrical bore 32 is a liquid reservoir 34 comprising a wadding 36 of fibrous liquid absorbent material, such as cotton or synthetic fibers. The wadding 36 is saturated with the hydrophobic composition. The lower end 30 of the housing 20 can be closed with a liquid tight plug 40. The applicator can be filled and refilled by removing the plug and filling with the hydrophobic composition. Alternatively, the hydrophobic composition and wadding 36 can be prepackaged in the form of a cartridge inserted into the bore 32.

The dispensing end 28 of the housing 20 carries a fiber applicator 42. The fiber applicator 42 may be formed of conventional material such as felt comprising natural and/or synthetic fibers, e.g. cotton, polyester, polyethylene and microfiber (blend of polyester and polyamide), and includes a substantially cylindrical body 44 having a diameter substantially that of the bore 32 so that the applicator is tightly seated in the bore. Projecting upwardly from the body 44 is a wedge or chisel shaped applicator tip 48, while a cylindrical tail wick 50 projects downwardly into the wadding 36 of the reservoir 34 and is substantially surrounded by the wadding 36. The fibrous nature of the applicator 42 ensures that the liquid hydrophobic composition stored in the reservoir 34 will be drawn to the applicator tip 42 by capillary action. Alternatively or in conjunction with capillary action, pressure may be applied to the reservoir 34 to force the composition to the applicator tip 48. This may be accomplished by using a housing 20 made of a deformable thermoplastic material and pressing on the sides.

Figure 3:
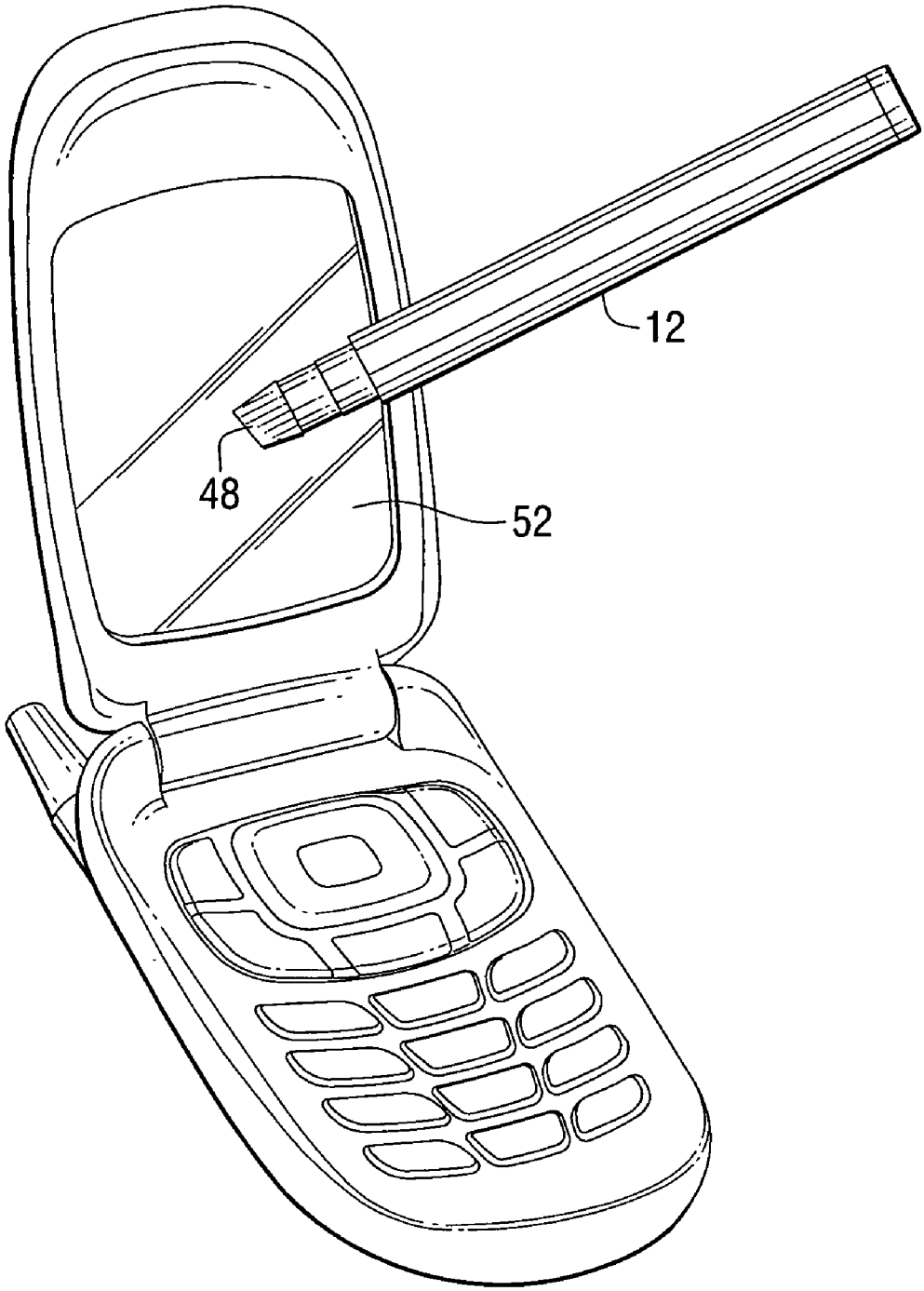
FIG. 3 is an elevational view of an applicator applying the hydrophobic composition of the invention to a personal data assistant.

As depicted in FIG. 3, the hydrophobic composition carried in the reservoir 34 may be easily applied as a coating to an optical surface 52 by grasping the body 12, contacting the surfaces to be treated with the applicator tip 48 and wiping the tip over the surface to be treated.

Figure 4:
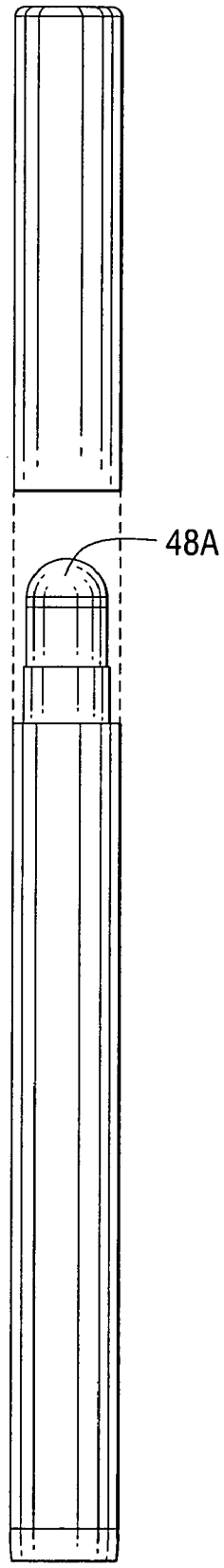
FIG. 4 is an elevational view of an alternate embodiment of an applicator useful in the practice of the invention.

An alternate embodiment of the invention is depicted in FIG. 4. The embodiment of FIG. 4 differs from the embodiment of FIGS. 1 through 3 in that, in lieu of employing a fiber applicator, a ball roller 48A is utilized. The ball roller 48A may comprise a conventional liquid applicator mechanism such as that disclosed in U.S. Pat. Nos. 4,490,350 or 5,154,525.

The ball roller can be made of ceramic, nylon or other synthetic material that will not be affected by the hydrophobic composition. The ball roller should be at one end of the housing in such a way that approximately one-half of the roller is in contact with the hydrophobic composition (the composition without the wadding) and the other half is accessible so as to roll across the surface to be treated.

The surfaces or substrates to which the hydrophobic compositions are applied may be an inorganic substrate such as a metal, metal oxide, metalloid including oxides thereof, or an organic substrate such as a polymeric substrate. The invention may also be used to apply the hydrophobic composition to optical articles, particularly small optical articles. The term "optical article" means an article that transmits or reflects visible light. Optical articles are typically transparent and can be formed from such materials such as glass and polymers. Examples of suitable polymers are acrylonitrile butadiene-styrene copolymers, polycarbonates, polyurethanes, polyamides, polyimides, poly(amide-imide), polyepoxides, polyesters such as polyethylene terephthalate, polyethylene naphthalate, acrylic polymers and copolymers, polysiloxanes, polyolefins, polyaromatics, polyvinyl alcohol, polysaccharides and polymers derived from cellulose such as cellulose triacetate. In many cases, the polymer has reactive or strongly interacting groups at the surface, such as aromatics, amides, carbonyls, siloxanes or silanes, nitriles, unsaturated bonds, hydroxyls, etc. Preferably, the polymer surface has carbonyl, amide, hydroxyl, ether or oxide groups. Specific examples of optical articles are ophthalmic articles such as those associated with eyewear such as prescription lenses, sunglasses, goggles and face shields. Examples of other optical articles are electro-optical devices such as display screens such as those associated with light emitting diodes, liquid crystals and plasma screens. Other optical articles include mirrors, telescopes, binoculars and camera lenses. Applying the hydrophobic composition with the applicator as described above is particularly useful for small optical articles having an optical surface area less than 15 $cm^2$, and preferably less than 10 $cm^2$ such as display areas associated with eyeglass lenses, cellular phones and personal data assistants. The hydrophobic compositions can be applied to such surfaces with the above-described applicator without wasteful overspray. Although the applicator can be used on larger surfaces, considerable time would be required to apply the hydrophobic composition. Conventional spraying and wiping would be a better application method for these larger surfaces.

The hydrophobic compositions are metal silicon complexes. By metal silicon complexes are meant reaction products of metals, particularly transition metals and silicon containing materials, particularly organosilanes and polysiloxanes.

The transition metal compound preferably is derived from niobium and transition metals that have electrons in the f electron orbital such as metals selected from Period 6 (lanthanide series) of the Periodic Table of elements. Examples of suitable metals include La, Hf, Ta, and W, with Ta being preferred. The ligand associated with the transition metal may be an alkoxide containing from 1 to 18, preferably 2 to 8 carbon atoms such as ethoxide, propoxide, isopropoxide, butoxide, isobutoxide and tertiary butoxide. The alkoxides may be in the form of simple esters and polymeric forms of the esters. For example, with the preferred metal Ta, the simple esters would be $Ta(OR)_5$ where R is $C_1$ to $C_{18}$ alkyl. Polymeric esters would be obtained by condensation of the alkyl esters mentioned above and typically would have the structure $RO—[Ta(OR)_3—O—]_xR$ where R is defined above and x is a positive integer. Besides alkoxides, examples of other ligands are halides, particularly chloride, acetyl acetonates, alkanolamine and lactate. Mixed ligands such as alkoxides and acetyl acetonates may also be present. $TaCl_5$ is a preferred transition metal compound.

Examples of silicon-containing materials are organosilicon-containing materials and organosilanes such as those having the formula:

$$R^1_{4-x}SiA_x \text{ or } (R^1_3Si)_yB$$

and organo(poly)siloxanes and organo(poly)silazanes containing units of the formula:

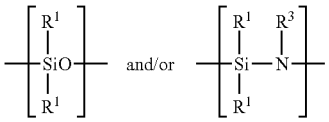

where $R^1$ are identical or different and are a monovalent including a substituted, such as halo, particularly fluoro-substituted hydrocarbon radical containing from 1 to 100, such as 1 to 20 carbon atoms and 1 to 6 carbon atoms. A in the above structural formula may be hydrogen, a halogen such as chloride, OH, $OR^2$ or

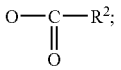

B in the above structural formula can be $NR^3_{3-y}$. $R^2$ is a monovalent hydrocarbon or substituted hydrocarbon radical containing from 1 to 12, typically 1 to 4 carbon atoms. $R^3$ is hydrogen or has the same meaning as $R^1$. x is 1, 2 or 3, y is 1 or 2.

Preferably, $R^1$ is a fluoro-substituted hydrocarbon. Examples of such fluoro-substituted hydrocarbons are those of the structure:

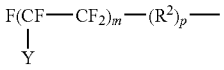

where Y is F or $C_nF_{2n+1}$; m is 4 to 20 and n is 1 to 6; $R^2$ is alkyl containing from 1 to 4 carbon atoms and p is 0 to 18. Also, fluoro-substituted hydrocarbons may be of the structure:

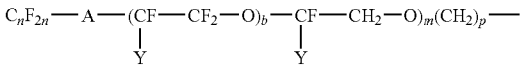

where A is an oxygen radical or a chemical bond; n is 1 to 6, y is F or $C_n$, $F_{2n}$; b is at least 1, such as 2 to 10; m is 0 to 6 and p is 0 to 18.

The organosilicon material can also be an organo(poly) siloxane or an organo(poly)silazane such as those having the structural units:

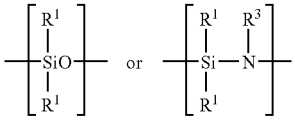

where $R^1$ is a hydrocarbon or substituted hydrocarbon having from 1 to 6 carbon atoms such as methyl and ethyl and $R^3$ is hydrogen or a hydrocarbon or substituted hydrocarbon having 1 to 6 carbon atoms. The organo(poly)siloxane may contain additional units of the formula:

$$R^5_2SiO_2$$

where $R^5$ is a halogen such as a chloro or fluoro substituent.

The organo(poly)siloxane and organo(poly)silazane typically have a number average molecular weight of at least 1000, usually between 1000 and 5,000,000.

The reaction products can be prepared by mixing the transition metal compound and the silicon-containing material in a closed system (i.e., low humidity) to avoid hydrolysis of the reactants. Reaction can occur neat or in the presence of a non-reactive solvent such as chlorinated or fluorinated solvent, for example, methylene chloride. Reaction occurs rapidly at room temperature and is complete from 1 to 30 minutes depending upon the reactants. Also, once again depending upon the reactants, heat can be used to initiate and complete the reaction. Solvent can be removed by evaporation and the reaction product can be redissolved in a suitable solvent such as an alcohol, for example, ethanol or propanol, for application to the substrate. The mole ratio of the organosilicon-containing material to transition metal compound is typically from 100:1 to 1:100, preferably from 1:1 to 10:1 depending on the valence of the transition metal compound. For example, the molar ratio of organosilicon compound to Ta(V) is typically 5 to 1.

The reaction product is typically dissolved or dispersed in an organic diluent. Examples of suitable diluents are alcohols such as methanol, ethanol and propanol, aliphatic hydrocarbons such as hexane, isooctane and decane, ethers, for example, tetrahydrofuran, and dialkylethers such as diethylether, on the transition metal specie to make the resulting complex more stable.

Also, adjuvant materials may be present in the composition. Examples include stabilizers such as sterically hindered alcohols and acids or surfactants. Also, additional active agents may also be incorporated into the coating composition, such as antibacterial agents, anti-static compounds, lubricants, etc. The adjuvants if present are present in amounts of up to 30 percent by weight based on the non-volatile content of the composition.

The concentration of the reaction product in the composition is not particularly critical but is usually at least 0.01 millimolar, typically from 0.01 to 100 millimolar, and more typically from 0.1 to 50 millimolar.

The composition can be obtained by mixing all of the components at the same time with low shear mixing or by combining the ingredients in several steps. The reaction product is reactive with moisture, and care should be taken that moisture is not introduced with the diluent or adjuvant materials and that mixing is conducted in a substantially anhydrous atmosphere.

The applicator is filled with the hydrophobic composition and the composition is applied to the surface to be treated with the applicator. This is typically accomplished by grasping the housing of the applicator by hand with the applicator tip pointed toward the surface to be treated. The applicator tip is placed on the surface and rubbing the applicator tip across the surface so as to deposit a layer of the hydrophobic composition on the surface. After the layer has been applied, the applicator tip is removed from the surface and the treated surface optionally wiped with a cloth or paper towel.

The resultant layer is thin, having a thickness less than 100 nanometers, typically 2 to 50 nanometers, and is hydrophobic, having a water contact angle less than 70°, typically from 75-130°. The squalene contact angle is greater than 20°. The water contact angle and the squalene contact angle can be determined using a contact angle goniometer such as a TANTEC contact angle meter Model CAM-MICRO.

Since various possible embodiments might be made of the present invention and since various changes might be made in the exemplary embodiments set forth herein without departing from the spirit of the invention, it is to be understood that all matter herein described or shown in the accompanying drawings is to be interpreted as illustrative and not in a limiting sense.

The invention is now set forth in the following claims.

What is claimed is:

1. An applicator for applying a hydrophobic composition to a surface comprising:

(a) a housing containing a flowable hydrophobic composition comprising a metal silicon complex;

(b) an applicator tip being fixed to the housing;

(c) the applicator tip being capable of depositing a layer of the composition on the surface in response to contact between the applicator tip and the surface.

2. The applicator as described in claim 1, that further comprises a means for facilitating flow of the composition from the housing to the applicator tip.

3. The applicator as described in claim 2 in which the means for facilitating flow of the composition from the housing to the applicator tip is by capillary action.

4. The applicator as described in claim 2 wherein the housing is formed of a deformable plastic material and the means for facilitating the flow of the composition from the housing to the applicator tip is by exerting pressure against the housing.

5. The applicator as described in claim 1, which is pen-shaped.

6. The applicator as described in claim 1 in which the applicator tip is made of felt, microfiber, cotton or polyester.

7. The applicator as described in claim 1 in which the applicator tip is wedge-shaped.

8. The applicator as described in claim 1 in which the applicator tip comprises a ball roller.

9. The applicator as described in claim 1 further comprising a tight-fitting cap.

10. The applicator as described in claim 1 in which the hydrophobic composition when deposited on the surface has a contact angle greater than 70°.

11. The applicator as described in claim 1 in which the hydrophobic composition when deposited on the surface has a squalene contact angle greater than 20°.

12. The applicator as described in claim 1 in which the hydrophobic composition when deposited on the surface has a thickness less than 100 nanometers.

13. The applicator as described in claim 1 in which the housing is substantially impervious to the transmission of water vapor.

14. The applicator of claim 1 in which the metal silicon complex is the reaction product of a transition metal and a silicon-containing material.

15. The applicator of claim 14 in which the transition metal is selected from Period 6 of the Periodic Table of Elements.

16. The applicator of claim 15 in which the transition metal is selected from La, Hf, Ta, W and Nb.

17. The applicator of claim 16 in which the transition metal is Ta.

18. The applicator of claim 14 in which the silicone containing material is an organosilicon material which has a formula selected from $$R^1_{4-x}SiA_x \text{ or } (R^1_3Si)_yB$$

and an organo(poly)siloxane and an organo(poly)silazane containing units of the formula:

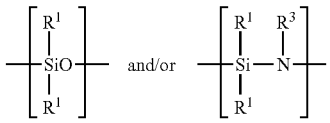

where:

$R^1$ are identical or different and are a monovalent hydrocarbon or substituted hydrocarbon radical containing from 1 to 100 carbon atoms, A is hydrogen, halogen, $$OH,\ OR^2 \text{ or } O-\underset{\underset{O}{\|}}{C}-R^2;$$

B is $NR^3_{3-y}$;

$R_2$ is a monovalent hydrocarbon or substituted hydrocarbon radical containing from 1to 12 carbon atoms, $R^3$ is hydrogen or is the same as $R^1$, x is 1,2 or 3, y is 1 or 2.

19. The applicator of claim 18 in which the organosilicon material is an organopolysiloxane.

20. The applicator of claim 19 in which the organopolysiloxane has a number average molecular weight of at least 1000.

21. The applicator of claim 20 in which the organopolysiloxane has a number average molecular weight of 1000 to 5,000,000.

* * * * *